US006135443A

United States Patent [19]

Yano

[11] Patent Number: 6,135,443

[45] **Date of Patent: *Oct. 24, 2000**

[54] SHEET FEEDING DEVICE

[75] Inventor: Kanji Yano, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/083,391

[22] Filed: May 22, 1998

[30] Foreign Application Priority Data

Jun. 2, 1997 [JP] Japan ..... 9-159184

[51] Int. Cl.[7] ..... B65H 3/52; B65H 1/08; B65H 1/10; B65H 3/34

[52] U.S. Cl. ..... 271/121; 271/127; 271/124; 271/160; 271/167

[58] Field of Search ..... 271/121, 124, 271/127, 160, 167

[56] References Cited

U.S. PATENT DOCUMENTS 4,330,115 5/1982 Mouri et al. ..... 271/124
4,954,845 9/1990 Yano et al. ..... 355/290
5,058,877 10/1991 Fujiwara et al. ..... 271/124
5,088,715 2/1992 Shibata et al. ..... 271/9 X
5,240,242 8/1993 Ando et al. ..... 271/118
5,253,854 10/1993 Tanoue et al. ..... 271/10 X
5,259,607 11/1993 Hinonori et al. ..... 271/10 X
5,377,970 1/1995 Kikuchi ..... 271/121
5,934,664 8/1999 Murayama et al. ..... 271/118 X
5,997,198 12/1999 Murayama et al. ..... 400/624 X

*Primary Examiner*—William E. Terrell
*Assistant Examiner*—Kenneth Bower
*Attorney, Agent, or Firm*—Fitzpatrick, Cella, Harper & Scinto

[57] ABSTRACT

A sheet feeding device and an image forming apparatus including an auxiliary pusher section, disposed at a sheet loading plate, for pushing one end of each sheet loaded on a rotatable sheet loading plate towards a sheet feeding section. The auxiliary pusher section includes a pusher member for contacting each of the sheets, and a spring for biasing the pusher member towards the sheet feeding section. The auxiliary pusher section pushes the sheets against the sheet feeding section to allow reliable feeding of the sheets.

13 Claims, 5 Drawing Sheets

SHEET FEEDING DEVICE

BACKGROUND OF THE INVENTION

1. Field of the Invention

The present invention relates to an image forming apparatus, such as a copying machine, a printer, or a facsimile machine, for forming an image onto a sheet and, more particularly, to a sheet feeding device provided in the image forming apparatus.

2. Description of the Related Art

Hitherto, for example, copying machines, printers, and facsimile machines have been used as image forming apparatuses.

In general, copying machines are machines which read image information from an original and form an image on a sheet in accordance with the read image information. In recent years, copying machines capable of being used in communications have been made available. Such copying machines can receive read image information transmitted to the copying machines from an external device.

In general, printers are machines which form an image on a sheet based on image information transmitted from an external device, such as a computer. Facsimiles are, in general, machines which read an original, and which can be used in communications to transmit read image information to an external device and to form an image on a sheet in accordance with information received from an external device.

Image forming apparatuses of the aforementioned types are provided with a sheet feeding device for proper sheet feeding.

A sheet feed cassette of a sheet feeding device generally includes an inside plate. In the sheet feed cassette, a plurality of sheets are loaded in a stack on the inside plate, and a side regulating member and a rear end regulating member are moved and positioned in accordance with the size of the sheets. The inside plate is pushed upward by means of a biasing spring to bring the topmost sheet of the sheet stack into contact with a sheet feed roller, which rotates to feed the sheets one sheet at a time to an image forming unit to form an image on each of the sheets by a predetermined image forming means.

The rotational center of the inside plate is located at about the center of the sheet feed cassette. As the number of sheets in the cassette decreases, the inside plate is biased by the biasing spring, causing one end of the inside plate and one of the ends of each of the loaded sheets to move upwards while they move through a circular arc.

In addition, a separating means is provided for separating the sheets so that they are fed from the sheet feed cassette one sheet at a time. Examples of separating means used in, for example, a low-speed sheet feeding device which feeds 15 sheets per minute, include a pawl separating means and a friction separating means using a separating pad.

The pawls of the pawl separating means are disposed on both sides of one end of the cassette in such a manner as to allow only the topmost sheet of the stack of sheets to be transported by the sheet feed roller. Since the pawls are provided on both sides of one end of the cassette, the cassette cannot be easily replenished with sheets, and sheets of various sizes cannot be used. Therefore, the pawls must be formed, for example, into shapes that overcome the aforementioned problems, so that there is not much latitude in setting the optimum conditions, imposing limitations upon the designing of the pawl separating means.

The friction separating means, which allows the use of sheets of various sizes with relative ease, is widely used.

However, the above-described conventional sheet feeding device has the following problems.

The friction separating means comprises a separating pad provided at one face of the cassette, and a sheet feed roller provided at the upper portion of one end of the cassette. The sheets are separated by means of the separating pad and the sheet feed roller in order to feed them one sheet at a time. However, depending on the amount of shifting of the end of a sheet, the friction separating means having the above-described construction may fail to feed the sheets properly.

In particular, as the number of loaded sheets decreases, the ends of sheets tend to get shifted, so that the sheet feeding device frequently fails to feed the sheets properly.

A description will now be given of what tends to cause one end of a sheet to shift as the number of the loaded sheets decreases.

The inside plate of the cassette is rotatably supported near the center of the cassette such that one end of the inside plate can move through a circular arc.

One end of the sheets on the inside plate similarly move through a circular arc. When there are a large number of sheets, the sheets are set substantially horizontally. As the number of sheets decreases, the inside plate and the sheets move rotationally such that their ends move upward.

When the length of the sheet in the sheet transporting direction is defined as L, and the inside plate is tilted by an angle of $\theta$ degrees, the horizontal distance is equal to $L \times \cos \theta$. The larger $\theta$ becomes, the smaller the horizontal distance from the rotational center.

In other words, the smaller the number of sheets, the larger the distance between one end of the sheets and the sheet feed roller, so that the sheets tend to be improperly fed.

When the sheet feed roller is formed with a small diameter in order to produce a small sheet feeding device, the ends of the sheets tend to get separated from the sheet feed roller by a much greater distance, resulting in more frequent shifting of the ends of the sheets, so that the sheets tend to be improperly fed.

A description will now be given of the problems that occur when the horizontal distance from the rotational center decreases as $\theta$ increases.

The cassette is ordinarily provided with a side regulating plate and a rear end regulating plate for properly setting a sheet in position in accordance with the size of the sheet. Allowing for, for example, variations in sheet dimensional tolerances, or expansion of sheets caused by temperature changes and moisture absorption, the side regulating plate and the rear end regulating plate are set 1 to 2 mm beyond the edges of the sheets.

A universal cassette is available, in which the positions of the side regulating plate and the rear end regulating plate can be changed freely in accordance with sheet size. In a universal cassette, however, it is quite difficult to set the side regulating plate and the rear end regulating plate in exact correspondence with the sheet size, so that the user may set the side regulating plate and the rear end regulating plate 4 to 5 mm beyond the edges of the sheets.

Therefore, even in an ordinary cassette and a universal cassette, when the number of loaded sheets decreases, the sheets tend to get shifted. In particular, when the sheet is smaller than the standardized size, or when a sheet feed roller having a small diameter is used, one end of the sheets and the sheet feed roller tend to get separated by a large distance, so that the sheets tend to be improperly fed.

SUMMARY OF THE INVENTION

In view of the above-described problems, it is an object of the present invention to provide a highly reliable sheet feeding device which is easy to handle and ensures proper sheet feeding.

To this end, according to the present invention, there is provided a sheet feeding device comprising a rotatable sheet loading plate for loading a plurality of sheets thereon; sheet feeding means, disposed adjacent the leading end of the sheets loaded on the sheet loading plate, the sheet feeding means contacting the end of an uppermost of the sheets for feeding the uppermost sheet; biasing means for biasing the sheet loading plate towards the sheet feeding means; and auxiliary pusher means, disposed at the sheet loading plate, for biasing the leading end of each of the sheets towards the sheet feeding means by contacting the sheets at a point upstream in the sheet feeding direction to a point where each of the loaded sheets and the sheet feeding means contact each other.

DESCRIPTION OF THE PREFERRED EMBODIMENT

A description will now be given of a preferred embodiment of the present invention with reference to the figures. Unless otherwise stated, in the present invention, the dimensions, the materials, the forms, the relative arrangement, and the like, of the component parts are not limited to those mentioned in the preferred embodiment.

Figure 1:
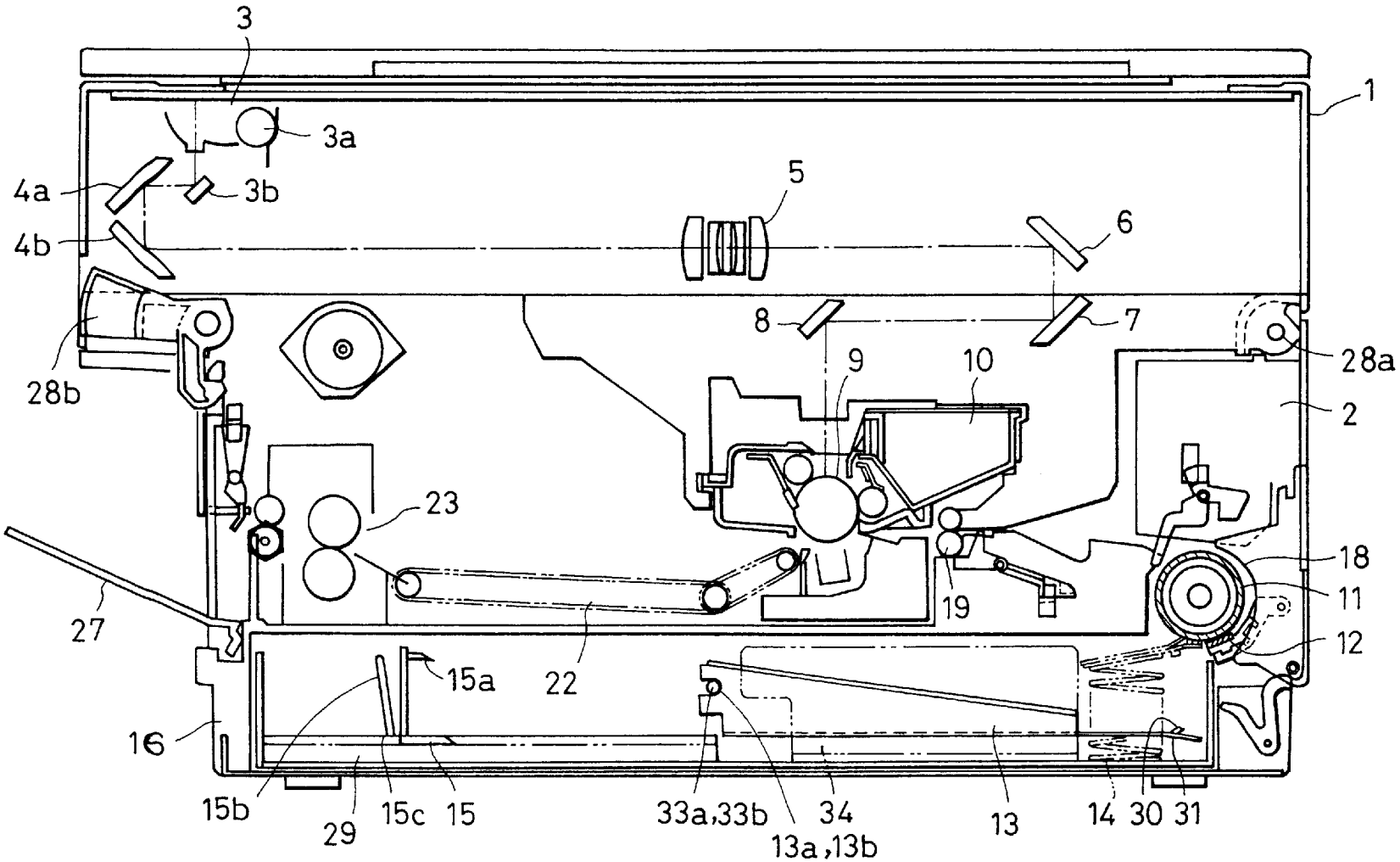
FIG. 1 is a sectional view of an example of an image forming apparatus with a sheet feeding device in accordance with the present invention.
Figure 2:
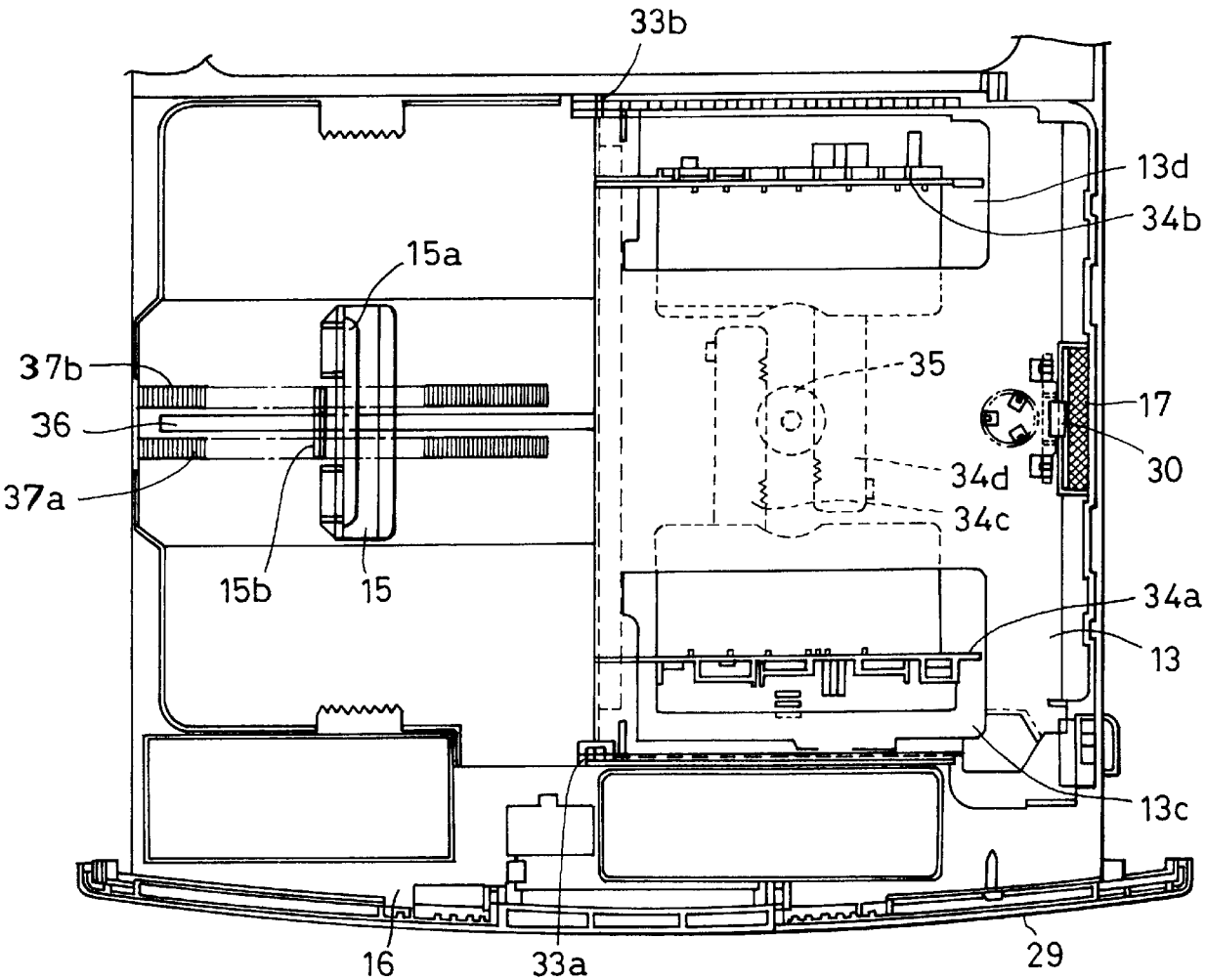
FIG. 2 is a plan view of the sheet feed cassette of the sheet feeding device of FIG. 1.
Figure 3:
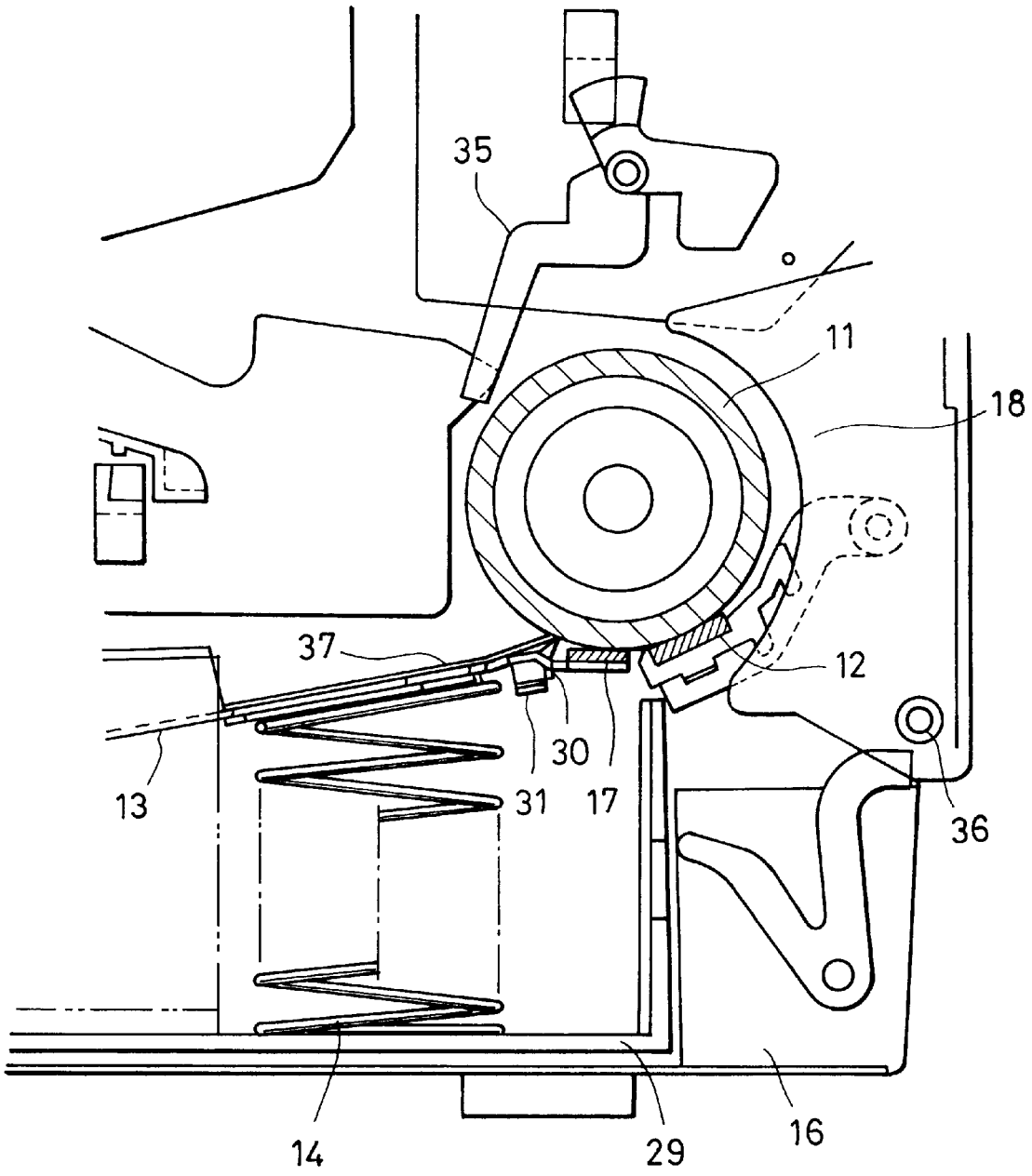
FIG. 3 is a view showing the main portion of the sheet feeding device.
Figure 4:
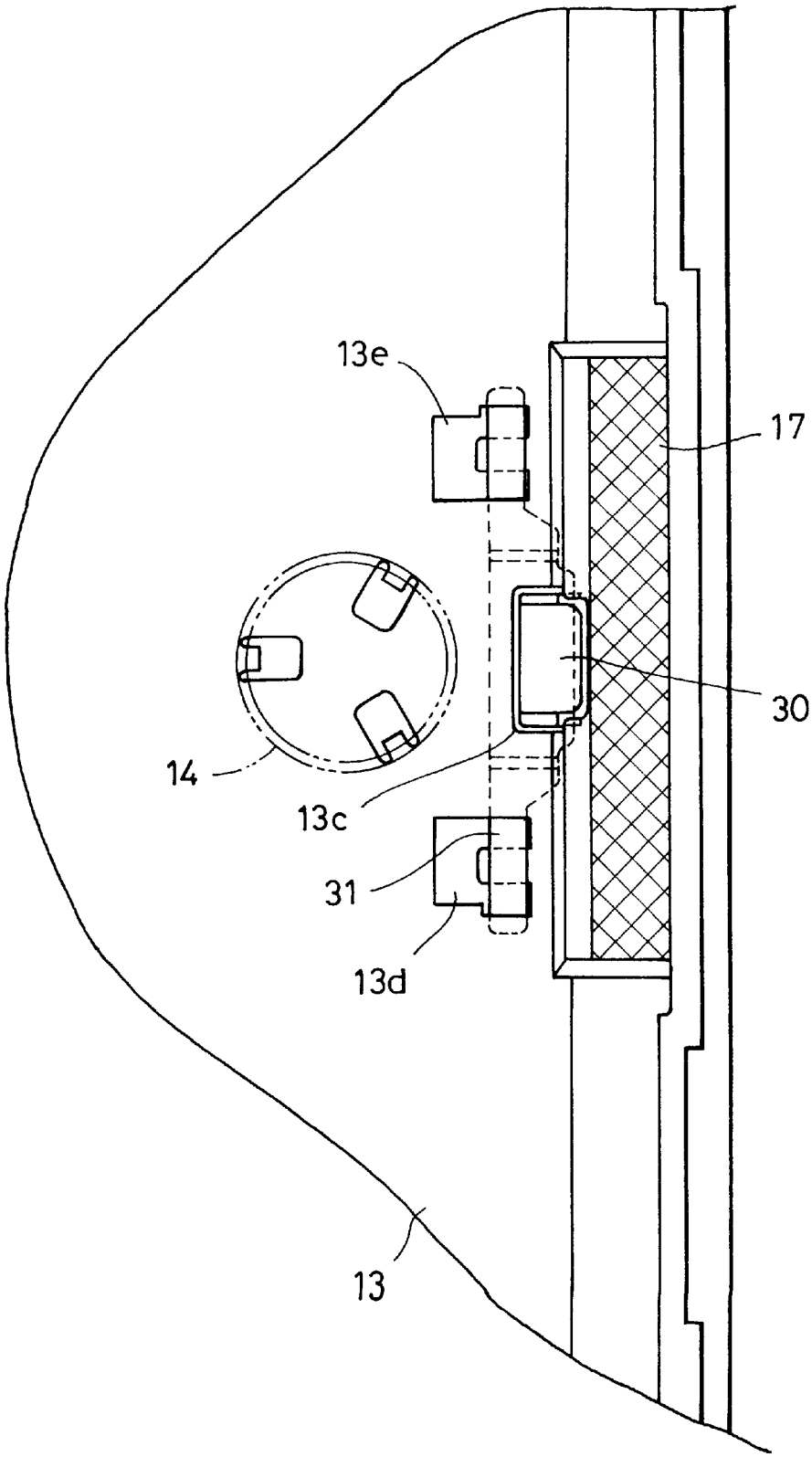
FIG. 4 is a plan view of the main portion of the sheet feeding device of FIG. 3.

FIG. 1 is a view illustrating the image forming apparatus, and FIGS. 2 to 4 are views each illustrating the sheet feeding device in the embodiment in accordance with the present invention.

In the embodiment, the sheet feed cassette is a front loading type, universal cassette, and is constructed so that it can be installed in the lower portion of the image forming apparatus, as shown in FIG. 1.

A description will now be given of the image forming apparatus, with reference to FIG. 1. In the present embodiment, a copying machine is used as an example of the image forming apparatus.

In general, the copying machine comprises a first frame member 1 including an image reading means for reading an original, and a second frame member 2 including a sheet feeding means, a transporting means, a transferring means, and a fixing means.

A sheet feed cassette 29 is installed in the lower portion of the second frame member 2, and has a handle 16 provided on a box-shaped base, allowing it to be drawn out towards the front side in FIG. 1.

The first frame member 1 and the second frame member 2 are linked together by means of a hinge shaft 28*a*. Releasing a hook 28*b* provided at the opposite side of the hinge shaft 28*a* allows the first frame member 1 to be opened about 45 degrees from the second frame member 2.

When the original is read at the first frame member 1, a mirror table 3, which is movable along a surface of the original, moves to allow scanning of the original.

The reflected light from a light source 3*a* travels successively to a mirror 3*b*, a mirror 4*a*, a mirror 4*b*, a zoom lens 5, and a mirror 6. Thereafter, the light travels to a mirror 7 and a mirror 8, provided at the second frame member 2 side, and irradiates a surface of a photosensitive drum 9 to form a latent image of the original on the surface.

A description will now be given of the formation of an image on a sheet, in the second frame member 2.

A process cartridge 10, serving as an image forming means, is provided to develop a latent image, formed on the photosensitive drum 9 by irradiating it with light carrying the image information of the original, using toner or the like.

Sheets on a sheet feed cassette 29 are each picked up by a sheet feed roller 11, and separated one sheet at a time by a separating pad 12. Then, each of the separated sheets passes along a U-turn guide 18, and is transported to a pair of register rollers 19.

The sheet, which has stopped moving at the register rollers 19, is transported in synchronism with and at a speed equal to the formation of the toner image on the photosensitive drum 9. The toner image is transferred onto the sheet by the transferring means. Then, the sheet with the transferred toner image is sent to a fixer 23 by a conveyor belt 22. The toner image is thermally fixed onto the sheet by the fixer 23, and the sheet with the fixed image is discharged onto a discharge tray 27.

A description will now be given of the sheet feeding device, whose structure is a distinguishing feature of the present embodiment.

In order to allow feeding of sheets of various sizes, the sheet feed cassette 29, as shown in FIGS. 1 and 2, is provided with movable side regulating plates or members 34*a* and 34*b* for regulating the positions of the sides of a sheet in the widthwise direction thereof, and a movable rear end regulating plate or member 15 for regulating the position of the rear end of a sheet.

The side regulating plates 34*a* and 34*b* comprise a rack 34*c* and a rack 34*d*, respectively, which engage a pinion gear 35. The pinion gear 35 and the racks 34*c* and 34*d* are represented by broken lines in FIG. 2. The racks 34*c* and 34*d* move symmetrically on both sides of the pinion gear 35 as a center, and are set in accordance with the width of, for example, an A4 size sheet or a B5 size sheet by a lock member (not shown).

The rear end regulating plate 15 is freely movable along a groove 36, which is formed reardwardy of the inside plate 13 of the cassette 29, as viewed in the sheet transporting direction, and along an extension of a centerline of the middle plate 13 extending midway between the sides of the middle plate 13, as viewed in the widthwise direction. A pawl 15*c*, engageable with pawls 37*a* and 37*b* provided on both sides of the groove 36, is provided below the handle 15*b*, allowing locking at any location.

In order to prevent overloading of sheets, and to allow proper decurling of sheets, a loading amount restricting member 15*a* is provided at the top portion of the rear end regulating plate 15.

A description will now be given of the inside plate 13 for loading sheets thereon.

The sheet feed cassette 29 is provided with a pin 33*a* and a pin 33*b*. The pin 33*a* is provided at about the middle of the side wall, disposed towards the front of FIG. 1, of the base 16, while the pin 33*b* is provided at about the middle of the side wall, disposed towards the back side of FIG. 1, of the base 16. The pins 33*a* and 33*b* are fitted into holes 13*a* and 13*b*, respectively, which are formed in both ends of the inside plate 13. Therefore, the inside plate can rotate freely, with the holes 13*a* and 13*b* as centers.

When the sheet feed cassette 29 is fully loaded with sheets, the inside plate 13 occupies a position indicated by a solid line in FIG. 1. As the number of sheets decreases, the inside plate 13, in FIG. 1, rotates counterclockwise around pins 33*a*, 33*b*. When the sheet feed cassette 29 runs out of sheets, the inside plate 13 rotates to a position indicated by alternate long and two short dashed lines.

In FIG. 1, the inside plate 13 is biased upwards at all times by an inside plate spring 14, being a biasing means, disposed between the inside plate 13 and the bottom of the base 16. The inside plate spring 14 is formed so as to allow an end of a sheet on the inside plate 13 to contact the sheet feed roller 11.

As shown in FIGS. 3 and 4, the center portion of the rotating end of the inside plate 13 is stepped downward, with a high friction member 17 provided at the downwardly stepped portion in order to prevent multiple feeding when a small number of sheets are on the inside plate 13.

Near the high friction member 17, a square hole 13*c* and hook holes 13*d* and 13*e* are formed in the center portion of the rotational end of the inside plate 13. These holes are through holes.

The hook holes 13*d* and 13*e* are formed for engagement with both arms of a plate spring 31, serving as an auxiliary pusher means and mounted to the back side of the inside plate 13.

A front end guide 30, serving as a pusher member, is mounted to the center portion of the plate spring 31, and passes through the square hole 13*c* so as to protrude from the inside plate 13 to the sheet loading side. In addition, the front end guide 30 has an inclined surface which inclines towards the sheet feed roller 11, towards the downstream direction.

Figure 5:
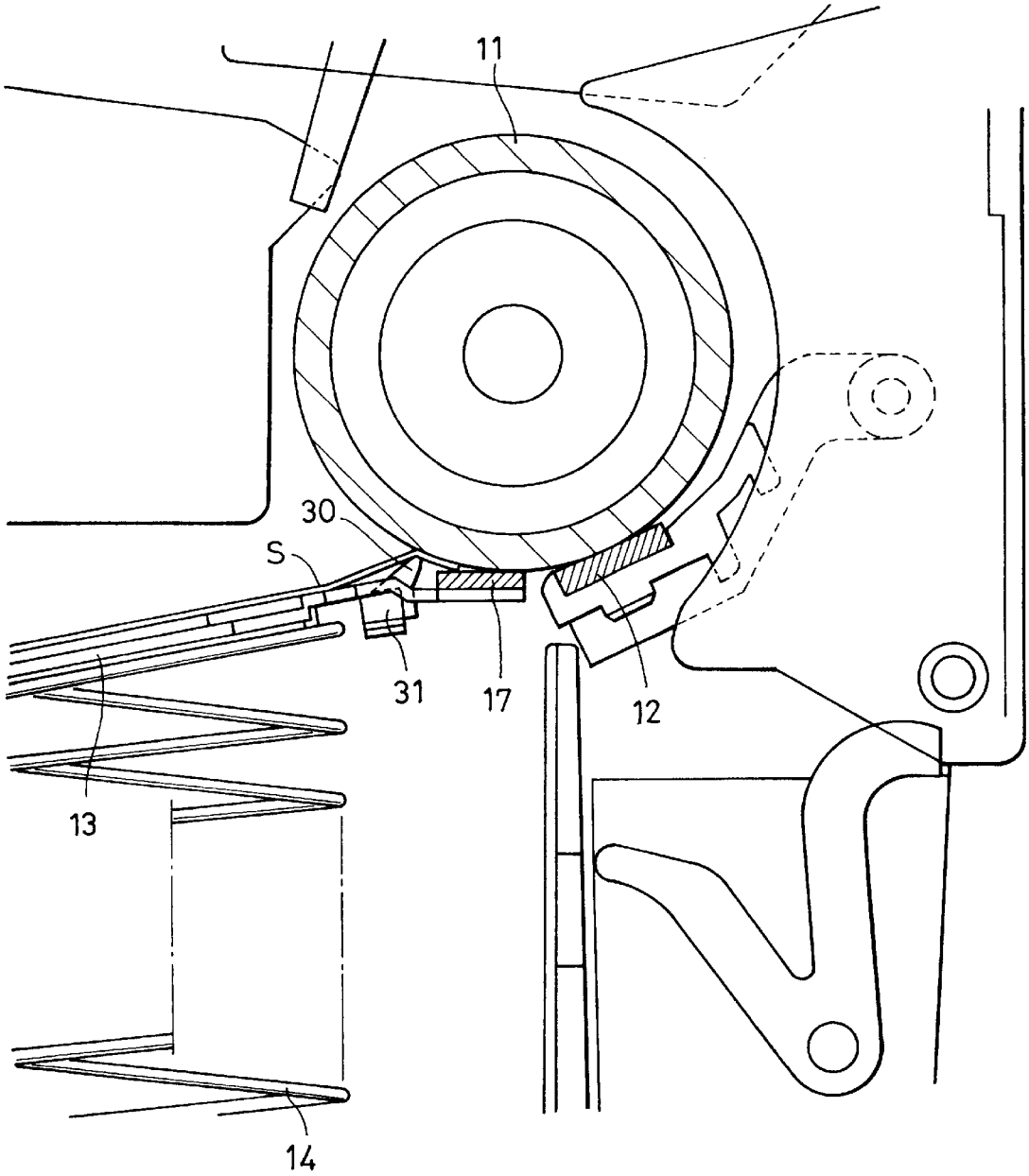
FIG. 5 is an enlarged view of the main portion of the sheet feeding device of FIG. 3.

As shown in FIG. 5, the front end guide 30 is inclined upwards to the right to ensure contact between one end of sheet S with the sheet feed roller 11, so that, for example, even contact of one end of the last sheet S with the sheet feed roller 11 can be ensured.

The plate spring 31 provides a weak spring pressure of, for example, a few dekagrams. In this case, when there are only a small number of sheets on the inside plate 13, the plate spring 31 protrudes towards the sheet loading side to ensure contact of one end of a sheet S with the sheet feed roller 11, whereas when there are a large number of sheets on the inside plate 13, the plate spring 31 is pushed back within the inside plate 13 by the weight of the sheets.

By virtue of the above-described structure, even when the number of sheets decreases, so that an end of sheet S is separated by a large distance from the sheet feed roller 11, proper feeding of the sheet S can be ensured. Therefore, even when a sheet feed roller with a small diameter is used, proper feeding of the sheet S can be ensured. Consequently, a small diameter sheet feed roller can be used to reduce the size of the sheet feeding device.

For example, even in the case where the rear end restricting plate 15 gets shifted more than 3 to 4 mm towards the rear when a user is replenishing the sheet feed cassette 29 with sheets, one end of sheet S contacts the sheet feed roller 11, so that proper sheet feeding can be ensured up to the last sheet.

The plate spring 31 is not exposed to the sheet loading portion side, so that the user will not accidentally load the sheets in such a way as to cause any of the sheets to get caught by the plate spring 31. In addition, even when the plate spring 31 contacts the front end guide 30, the front end guide 30 moves within the inside plate 13, allowing it to be easily handled.

Although in the foregoing description a universal cassette was used to described the sheet feeding device, a cassette in which the rotational center is located at the inside plate, and one end of the inside plate describes a rotational path may also be used to produce similar effects. In addition, the structure of the present invention may also be applied to a rotatable tray mounted to the body of an image forming apparatus.

Although a copying machine was used as an example of the image forming apparatus, other types of image forming apparatuses, such a printer or a facsimile machine, may also be used.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet feeding device, comprising:

a rotatable sheet loading plate for loading a plurality of sheets thereon, each of the sheets loaded having a leading end and a trailing end;

sheet feeding means for feeding an uppermost sheet of the sheets on the loading plate, said sheet feeding means disposed adjacent the leading end of the sheets loaded on said sheet loading plate, and said sheet feeding means contacting the leading end of an uppermost of sheets for feeding the uppermost sheet;

biasing means for biasing said sheet loading plate towards said sheet feeding means, so that the sheets loaded on said sheet loading plate are biased toward said sheet feeding means; and auxiliary pusher means, mounted to said sheet loading plate and disposed on an upstream side in the sheet feeding direction of a position where said sheet loading plate and said sheet feeding means contact each other, for biasing the sheets loaded on said sheet loading plate towards said sheet feeding means.

2. A sheet feeding device according to claim 1, further comprising a sheet feeding cassette removable from the body of said sheet feeding device; wherein said sheet loading plate is in said sheet feeding cassette; wherein said sheet feeding means is provided in the sheet feeding device body; and wherein when said sheet loading plate is mounted to the sheet feeding device body side of said sheet feeding cassette, said biasing means, disposed between a base of said sheet feeding cassette and said sheet loading plate, biases said sheet loading plate towards said sheet feeding means.

3. A sheet feeding device according to claim 1, wherein said sheet feeding means and said auxiliary pusher means are disposed at locations corresponding to a center of the sheets, with respect to a widthwise direction of the sheets.

4. A sheet feeding device according to claim 1, further comprising a separating pad for separating the sheets fed from said sheet feeding means, said separating pad being contactable with said sheet feeding means.

5. A sheet feeding device according to claim 4, wherein said sheet loading plate is rotatably supported at an approximate center portion of the base in the sheet feeding direction.

6. A sheet feeding device according to claim 1, wherein said auxiliary pusher means comprises a pusher member for contacting the sheets, and a spring for biasing said pusher member towards said sheet feeding means.

7. A sheet feeding device according to claim 6, wherein said pusher member is mounted to said spring for movement in and out of an opening in said sheet loading plate allowing passage therethrough, and wherein said spring is mounted to a back side of said sheet loading plate, said spring being a plate shaped spring for biasing said pusher member in a direction in which said pusher member protrudes from said sheet loading plate.

8. A sheet feeding device according to claim 6 or 7, wherein said pusher member is inclined in a direction of said sheet feeding means, towards the downstream side in the sheet feeding direction.

9. A sheet feeding device according to claim 6 or 7, wherein when an amount of sheets in excess of a predetermined amount is loaded on said sheet loading plate, the biasing force of said spring causes said pusher member to move into said sheet loading plate from the upper surface of said sheet loading plate.

10. A sheet feeding device according to claim 9, wherein said pusher member is inclined in a direction of said sheet feeding means, towards the downstream side in the sheet feeding direction.

11. An image forming apparatus, comprising:

a rotatable sheet loading plate for loading a plurality of sheets thereon, each of the sheets loaded having a leading end and a trailing end;

sheet feeding means for feeding an uppermost sheet of the sheets on the loading plate, said sheet feeding means disposed adjacent the leading end of the sheets loaded on said sheet loading plate, and said feeding means contacting the leading end of each of an uppermost of the sheets for feeding the uppermost sheet;

biasing means for biasing said sheet loading plate towards said sheet feeding means, so that the sheets loaded on said sheet loading plate are biased toward said sheet feeding means;

auxiliary pusher means, mounted to said sheet loading plate, and disposed on upstream side in the sheet feeding direction of a position where said sheet loading plate and said sheet feeding means contact each other for biasing the sheets loaded on said sheet loading plate towards said sheet feeding means; and image forming means for forming an image onto each of the plurality of sheets fed by said sheet feeding means.

12. A sheet feeding device, comprising:

a rotatable sheet loading plate for loading a plurality of sheets thereon, each of the sheets loaded having a leading end and a trailing end, said rotatable sheet loading plate defining an opening therein;

sheet feeding means for feeding an uppermost sheet of the sheet on the loading plate, said sheet feeding means disposed adjacent the leading end of the sheets loaded on said sheet loading plate, and said sheet feeding means contacting the leading end of an uppermost of sheets for feeding the uppermost sheet;

biasing means for biasing said sheet loading plate towards said sheet feeding means; and auxiliary pusher means, mounted to said sheet loading plate, for ensuring contact between the sheets and said sheet feeding means; and a pusher member mounted to said auxiliary pusher means, wherein said pusher member is pushed upward, by said auxiliary pusher means, in a direction of the opening in said rotatable sheet loading plate to contact the sheets.

13. The sheet feeding device according to claim 12, wherein the auxiliary pusher means is mounted to a back side of said rotatable sheet loading plate.

* * * * *

UNITED STATES PATENT AND TRADEMARK OFFICE

CERTIFICATE OF CORRECTION

PATENT NO. : 6,135,443

DATED : October 24, 2000

INVENTOR(S): KANJI YANO

It is certified that error appears in the above-identified patent and that said Letters Patent is hereby corrected as shown below:

COLUMN 6:
Line 12, "described" should read --describe--.

COLUMN 7:
Line 39, "feeding" should read --sheet feeding--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*